United States Patent [19]

Ward

[11] Patent Number: 4,715,652

[45] Date of Patent: Dec. 29, 1987

[54] PORTABLE STADIUM SEAT WITH TRAY

[76] Inventor: James F. Ward, 3412 Chatsworth La., Orlando, Fla. 32806

[21] Appl. No.: 813,773

[22] Filed: Dec. 27, 1985

[51] Int. Cl.[4] ..... A47C 7/62

[52] U.S. Cl. ..... 297/252; 297/192; 297/188

[58] Field of Search ..... 297/252, 192, 188, 352

[56] References Cited

U.S. PATENT DOCUMENTS

| | | | |
|---|---|---|---|
| 2,519,771 | 8/1950 | Lacore | 297/188 |
| 2,701,006 | 2/1955 | Kandarian | 297/188 X |
| 3,560,047 | 2/1971 | Davis | 297/192 X |
| 3,594,039 | 7/1971 | Harp | 297/252 |
| 3,821,825 | 7/1974 | Bailey | 297/252 X |
| 4,341,418 | 7/1982 | Chappell | 297/192 |
| 4,432,525 | 2/1984 | Duvall | 297/252 X |
| 4,556,250 | 12/1985 | Chapman et al. | 297/275 X |

*Primary Examiner*—Peter A. Aschenbrenner
*Attorney, Agent, or Firm*—Edward M. Livingston

[57] ABSTRACT

A comfortable, lightweight and portable stadium seat with a slidably removable tray for spectator use is disclosed. This seat contains back rest and seat bottom portions with cushions attached to interconnected tubular rails so that the seat is collapsible for easy carrying. In addition the tray is mounted under the seat bottom portion in such a manner that it can be pulled out as needed to extend in front of the spectator for holding food and drinks. A safety feature consisting of a spring-loaded hook-like fastener mounted on the bottom of the seat and keeps the seat from tipping over backwards while in use.

4 Claims, 6 Drawing Figures

PORTABLE STADIUM SEAT WITH TRAY

BACKGROUND OF THE INVENTION

This invention relates to portable seats, particularly to those designed for use in stadiums while watching sporting events with provisions for holding food and drink.

The current standard stadium seat consists either of an aluminum bench attached to concrete or just concrete itself, without any back support. Such stadium seats are very uncomfortable to sit in while watching sporting events such as football, baseball and soccer, which often last for several hours. As a result, spectators usually leave the sporting events with sore buttocks and aching backs. In addition to the standard stadium seat having no back support, such seats also have no place to hold food or drink purchased at the event. Furthermore, there is usually little or no room to place the food or drink in a crowded stadium itself. Therefore, spectators must hold their food and drink or invite spillage.

Prior inventions have attempted to solve the aforementioned problems but none have done it all, particularly in the same or similar fashion as the instant invention. For instance, U.S. Pat. No. 4,474,407 by Nazar shows a portable seat with provision for storage only. Thus, the Nazar invention lacks a tray and also, the means of attaching the seat to the stadium seat to prevent tipping or sliding. U.S. Pat. No. 2,865,433 by Warner, discloses a stadium seat with article carrier, but the article carrier is designed for storage, and cannot be used as a tray. Furthermore, the Warner patent has no back support for the spectator. Another patent, U.S. Pat. No. 3,120,404 by Bramming shows a stadium seat that has a fold down lunch box rather than a tray. Contrary to the instant invention, the lunch box in this case must always be out even when not in use and is not useable as a tray. Thus, none of the prior art as represented by these patents contain devices that solve all the problems as does the instant invention.

The instant invention resolves the aforementioned problems by providing a comfortable seat comprised of a seat bottom portion consisting of a cushion made of foam or other material covered by vinyl or cloth, a connecting back support with a foam cushion covered by vinyl, a slidably removable tray to hold drinks and food and a spring loaded retractable metal latch to hold the seat onto the stadium seat so that the occupant will not fall over backwards while using it.

SUMMARY OF THE INVENTION

The primary object of this invention is to provide a low cost, lightweight stadium seat. A corollary object of this invention is to provide such a seat with a comfortable back support for the spectator.

A third object of this invention is to provide such a comfortable stadium seat with means for holding food and drink.

An even further object is to provide such a seat which is safe for the spectator, which will not tip over backwards if a spectator leans back while watching a sporting event.

The instant invention provides these objects and more by providing a stadium seat with both a cushioned back rest and seat bottom comprised of cushions of foam or other material covered by vinyl or cloth. The back and seat portions are inter-connected by lightweight aluminum and/or plastic support rails which are connected by rivets or rods so that the seat is collapsible for easy portability.

Means of holding food and drink is provided by a slidably removable tray inserted under the seat bottom into grooves between supporting boards below the seat bottom.

Finally, the seat is made safe by providing a spring-loaded latch hook which fits under the front bottom of the seat and attaches under the stadium seat, thereby keeping the seat from tipping when the spectator leans back while watching a sporting event.

BRIEF DESCRIPTION OF THE DRAWINGS

The illustrations which describe the instant invention and which accompany this patent application are as follows.

DESCRIPTION OF THE PREFERRED EMBODIMENTS

Figure 1:
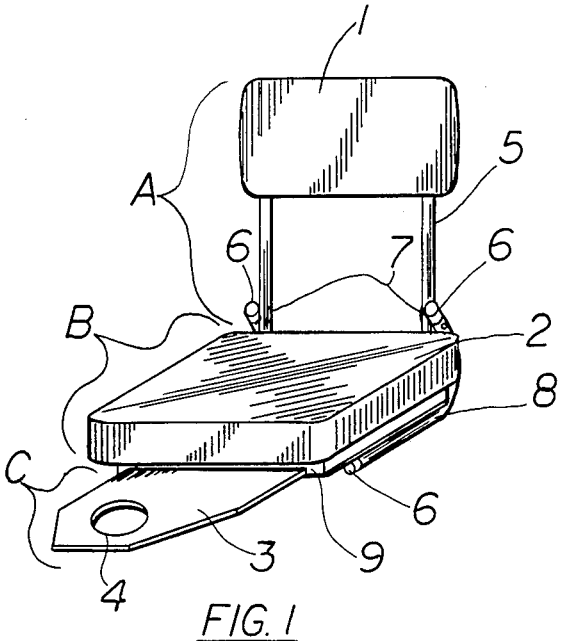
FIG. 1 is a prospective view showing the seat with the tray in use.
Figure 2:
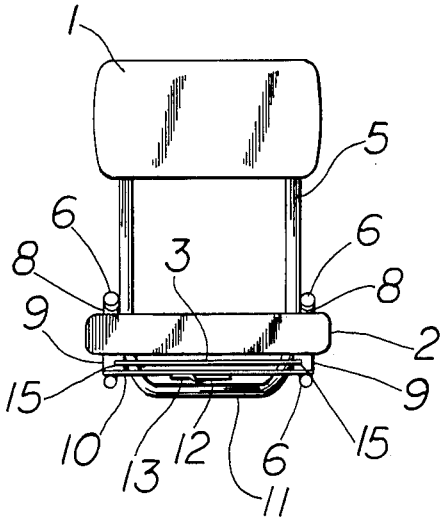
FIG. 2 is a front view of the invention.
Figure 3:
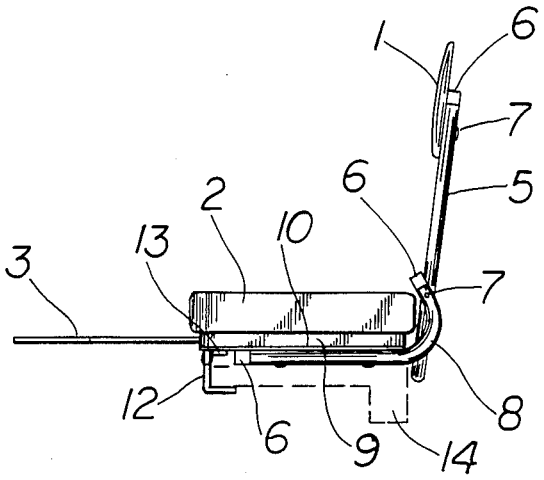
FIG. 3 is a side view of the stadium seat showing it as it would appear in actual use attached to the stadium seat.

Referring now to the drawings, the invention will be described in detail. As is best illustrated in FIGS. 1, 2 and 3, the invention consists of three main features, a back rest portion A, a seat bottom portion B and a tray portion C. The cushions, 1 and 2, respectively, in the back rest portion A and the seat bottom portion B may be made of either vinyl or cloth-covered foam cushions to provide comfort to the user.

The bottom seat cushion 2 is mounted onto two plastic or wood supports 9 which run along each side of the bottom of the seat cushion 2 from front to back. These supports 9 contain grooves 15 in which the tray 3 is mounted. A bottom encasement 10 is attached to each of the two supports 9 and covers the entire bottom of the seat cushion 2, thereby providing additional strength to the seat. Finally, two tubular rails, which may be made of aluminum steel or plastic rails 8 are attached to the bottom encasement 10 by rivets, bolts or screws 7. Said rails 8 run along the bottom along each side of the seat cushion 2 and curve up in back of said seat cushion 2 to attach to the back portion A by means of attachment to the support rail 5 by rivets or rods 7.

The back portion A of the invention consists of the back cushion 1 which is mounted on the top two ends of a U-shaped support rail 5 by screws or rivets 7. The back rest portion A is connected to the seat bottom portion B by attachment to the curved ends of the bottom support rails 8 using rivets or rods 7.

For safety purposes the ends of all the tubular rails used in this invention are covered by plastic caps 6. These plastic caps 6 avoid the user from being cut on the sharp edges of the rails.

The third major feature of this invention is the tray portion C designed for holding food and drinks on an "as needed" basis. The tray 3 fits between the two supports 9 into the two grooves 15 on the inner sides of the supports 9. The tray is kept in the "IN" position, i.e., slid under the seat, when not in use. When needed the tray is pulled outward with the hand until it extends in front of the seat the desired amount. The tray 3 may contain a cup hole 4 which also makes it easier to pull the tray 3 from under the seat bottom cushion 2. Thus, when the tray 3 is needed, the spectator simply places his or her hand into the cup hole 4 and pulls forward to the desired extension for holding food and drink. After the spectator is finished, the tray 3 can easily be pushed under the seat bottom cushion 2.

Figure 4:
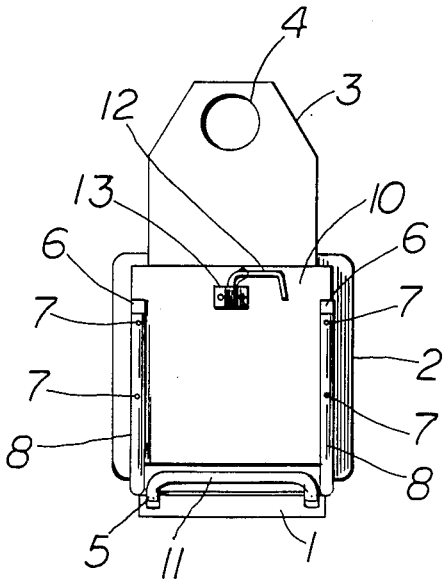
FIG. 4 is a bottom view of the seat.

In addition to the above features, on the bottom encasement 10 is a hook-like fastener 13 which is spring loaded, as is best shown in FIGS. 3 and 4. As shown in FIG. 3 this fastener 13 swings down and attaches to a stadium seat 14, thereby keeping the seat from slipping or tipping back if the spectator should lean back in the seat during a sporting event.

Figure 5:
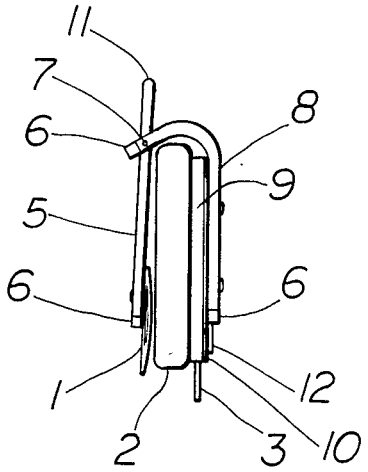
FIG. 5 is a view of the seat in collapsible form for carrying.

The portability of the invention is best exhibited in FIG. 5. Once the invention is removed from the stadium seat 14, the back cushion 1 closes over the seat bottom cushion 2 by folding the back portion A over the seat portion B around the rivets 7 which connect the back rails 5 and the seat bottom support rails 8. When the seat is collapsed in this fashion the back rails 5 are pushed by the slightly bent ends of the support rails 8 and the caps 6, thereby locking the seat in a completely folded position as shown in FIG. 4. Then, the seat can be easily carried by placing the hand around the curved bottom 11 of the back support rail 5.

Figure 6:
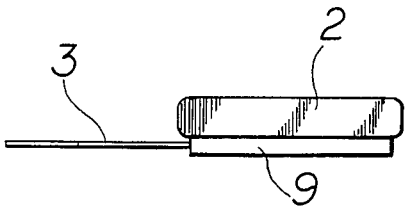
FIG. 6 is a side view of one embodiment of the seat without back rest.

A second embodiment of the invention is shown in FIG. 6, this embodiment consists of a seat cushion 2 with the supports 9 attached to the bottom thereof running from front to back and containing the same grooves 15 on the inner sides thereof (not shown in the drawing) into which a tray 3 can be slidably inserted and removed. Although the second embodiment could be used in regular stadium seats, it is designed primarily for use on a stadium seat which already has a back rest. Thus, this latter embodiment provides added comfort, helps to prevent sore buttocks and provides a means of holding food and drink.

In summary, the instant invention as described in two embodiments, provides a light-weight, low-cost, portable seat for use in the stadiums which increases spectator comfort and allows spectators to enjoy food and drink without the high risk of spillage.

While the invention has been described in detail above, it is to be understood that some modifications may be made from the specific details described herein and still be included within the spirit scope of the invention and the claims as set forth hereinbelow.

What is claimed is

1. A portable stadium seat comprised of:

a seat bottom portion consisting of a covered seat cushion mounted on two support pieces running from front to back on each side of said cushion, each support piece containing a groove on the inner side thereof, a flat encasement piece connecting both support pieces, said encasement having attached at the front middle thereof a spring-loaded hook-like fastener member which, when in the downward "OPEN" position attaches to the underside of a stadium seat and two tubular elements or rails attached to each side of the encasement piece running from front to back of the encasement piece; and a back rest portion consisting of a curved cushion which is mounted to the two upper ends of a U-shaped support rail or tubular element, said back portion being attached to the seat bottom portion by means of connecting elements such as rods or rivets; and a tray which fits into the grooves between the two support pieces of the seat bottom portion, which can be slidably extended from the front of the seat portion to hold food and drink.

2. The portable stadium seat of claim 1 which collapses by folding the back rest portion over the seat bottom portion by means of rods or rivets connecting the interconnecting tubular elements or support rails of the seat bottoms and back rest portions.

3. A portable stadium seat comprised of:

a seat bottom portion consisting of a covered seat cushion mounted on two support pieces running from front to back on each side of said cushion, each support piece containing a groove on the inner side thereof, a flat encasement piece connecting both support pieces, said encasement having attached at the front middle thereof a spring-loaded hook-like fastener member which, when in the downward "OPEN" position attaches to the underside of a stadium seat and two tubular elements or rails attached to each side of the encasement piece running from front to back of the encasement piece;

a back rest portion consisting of a curved cushion which is mounted to the two upper ends of a U-shaped support rail or tubular element, said back portion being attached to the seat bottom portion by means of connecting elements such as rods or rivets; and a tray which fits into the grooves between the two support pieces of the seat bottom portion, which can be slidably extended from the front of the seat bottom portion, to hold food and drink.

4. A portable stadium seat comprised of:

a seat bottom portion consisting of a covered seat cushion mounted on two support pieces running from front to back on each side of said cushion, each support piece containing a groove on the inner side thereof, a flat encasement piece connecting both support pieces, said encasement having attached at the front middle thereof a spring-loaded hook-like fastener member which, when in the downward "OPEN" position attaches to the underside of a stadium seat and two tubular elements or rails attached to each side of the encasement piece running from front to back of the encasement piece;

a back rest portion consisting of a curved cushion which is mounted to the two upper ends of a U-shaped support rail or tubular element, said back portion being attached to the seat bottom portion by means of connecting elements such as rods or rivets; and a tray having a hole in the front portion thereof which fits into the groove between the two support pieces of the seat bottom portion, which can be slidably extended from the front of the seat bottom portion, to hold food and drink.

* * * * *